United States Patent [19]

Scavenius

[11] 4,139,116

[45] Feb. 13, 1979

[54] CABINET WITH TWO OR MORE DRAWERS

[76] Inventor: Jens E. B. Scavenius, Soterassen 10, DK-2840 Holte, Denmark

[21] Appl. No.: 771,404

[22] Filed: Feb. 23, 1977

[30] Foreign Application Priority Data

Mar. 15, 1976 [DK] Denmark ..... 1112/76

[51] Int. Cl.[2] ..... E05C 15/04

[52] U.S. Cl. ..... 220/217

[58] Field of Search ..... 312/215-221

[56] References Cited

U.S. PATENT DOCUMENTS

| | | | |
|---|---|---|---|
| 1,928,265 | 9/1933 | Rand | 312/217 |
| 2,240,067 | 4/1941 | Bolesky et al. | 312/221 |
| 2,952,497 | 9/1960 | Bowden | 312/221 |
| 3,023,066 | 2/1962 | Mohr et al. | 312/219 |
| 3,038,770 | 6/1962 | Kurens | 312/221 |
| 3,404,929 | 10/1968 | Wright et al. | 312/222 |
| 3,454,320 | 7/1969 | Olree | 312/221 |

FOREIGN PATENT DOCUMENTS

| | | | |
|---|---|---|---|
| 111233 | 1/1907 | Fed. Rep. of Germany | 312/220 |
| 2240643 | 8/1973 | France | 312/220 |

*Primary Examiner*—Jacob Shapiro
*Attorney, Agent, or Firm*—Brumbaugh, Graves, Donohue & Raymond

[57] ABSTRACT

The present invention relates to a cabinet having two or more drawers, more specifically for safe-keeping of records such as papers, documents, file cards or the like, comprising at least one vertical, pivotally mounted locking bar of substantially uniform cross section and having two projecting portions, said locking bar being adapted to cooperate with parts of or on the drawers so that after pulling out one drawer it will lock and prevent the other drawer or drawers from being pulled out. The locking device of such a cabinet eliminates the risk of the cabinet turning over as a result of two or more heavily loaded drawers being pulled out simultaneously.

12 Claims, 10 Drawing Figures

Figure 4:
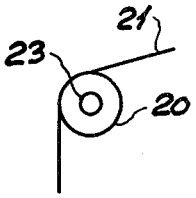

Fig. 1
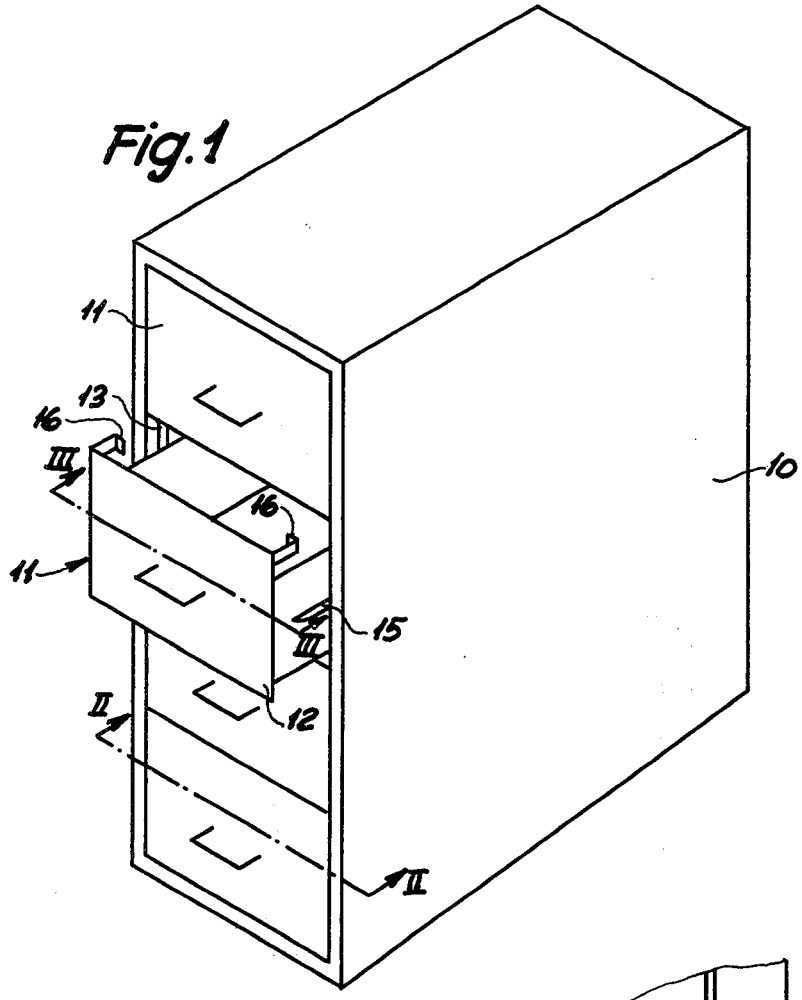
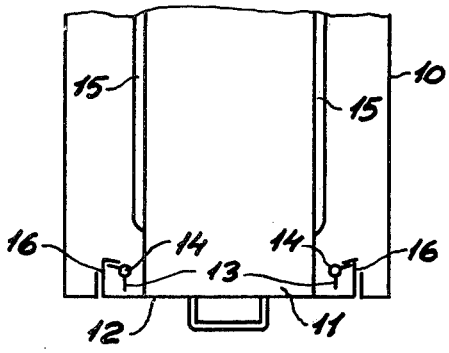
Fig. 2
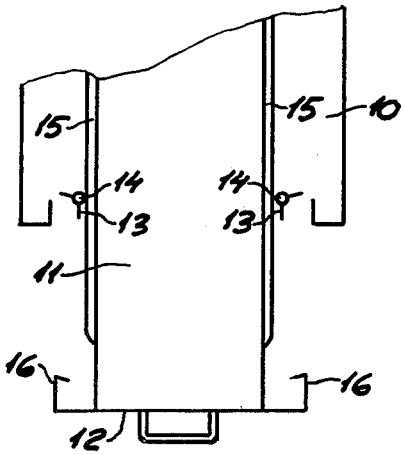
Fig. 3

CABINET WITH TWO OR MORE DRAWERS

It is often desirable that a file cabinet should be flexible in the sense that it should be easy to choose between a few deep drawers and more shallow drawers or possibly use combinations of deep and shallow drawers. In the prior-art cabinets of the subject type the locking bar is longitudinally displaceable, and the said flexibility therefore requires that the locking bar be provided with a locking mechanism adjacent each possible position of drawers, which means that many cabinets include a number of elements that are never used.

It is the object of the invention to provide a cabinet of the subject type whose locking device, without using any additional elements and without any switching, permits use of any combination of drawers.

This object is achieved by arranging the locking bar proximate the front of the cabinet and next to the drawers, and where one of its two projecting portions is actuated to pivot the locking bar into locking position by a rail provided at the side of each drawer when a drawer is pulled out, while the other projection cooperates with a retaining hook being secured to each drawer so as to face inwardly and prevent with the locking bar retained in the locking position by an open drawer that another drawer is pulled out, whereas when the locking bar is not retained it will bypass the latter subject to pivoting thereof in a direction away from the locking position. As it is, the uniform cross section and pivotal mounting of the locking bar render its function quite independent of the position of the drawers along the locking bar. The claimed structure has the added advantage that the locking bar is positively controlled by the drawers, with the effect that the risk of it becoming jammed as a result of rust, dirt, pieces of paper or the like is negligible.

To ensure that the locking bar is not moved into an inoperative position, the cabinet may be provided with stopping means for limiting pivotal movement of the locking bar, to the effect that the stopping means are capable of maintaining the locking bar within an angular area whereby either the retaining hook or the rail of a drawer is certain to engage one or the other of the projecting portions of the locking bar as the drawer is pulled out.

A simple and inexpensive embodiment of the locking bar can be obtained by making it from sheet material bent at an angle of between 90° and 180°. The pivot axis of the locking bar may be located in or proximate the vertex or spaced behind the vertex towards the rear of the cabinet. The latter location of the pivot axis offers the advantage compared to the former that it allows a wider margin, i.e. requires less accurate location of the pivot axis.

An embodiment of which the angle between the legs of the locking bar is less than 180° is characterized by further providing a third plate member interconnecting the extremities of the two legs, whereby the locking bar will have a high degree of rigidity because of its closed triangular cross section.

Another embodiment, in which each drawer has a front plate projecting laterally from the sides of the drawers, is characterized by securing the retaining hook to the front plate at one lateral edge thereof, said hook being of resilient material and having a rearward bevelled cam face so that when closing the drawer with the locking bar in the locking position it is able to pass the locking bar subject to resilient deflection. This embodiment of the cabinet achieves in a simple manner such a positioning of the retaining hook that it is able to actuate the locking bar outside the latter's pivot axis and consequently for movement away from the locking position.

Yet another embodiment, which is characterized by the provision of two symmetrical locking devices on respective sides of the drawers, is particularly advantageous in combination with wide drawers.

The locking device stated is readily combined with a master locking assembly by means of which the locking bar or bars may be moved into and retained in the locking position, also in such a manner that the two locking devices continue to operate quite independently of each other.

Figure 7:
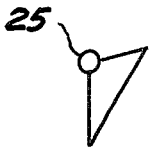
Figure 8:
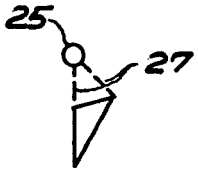
Figure 9:
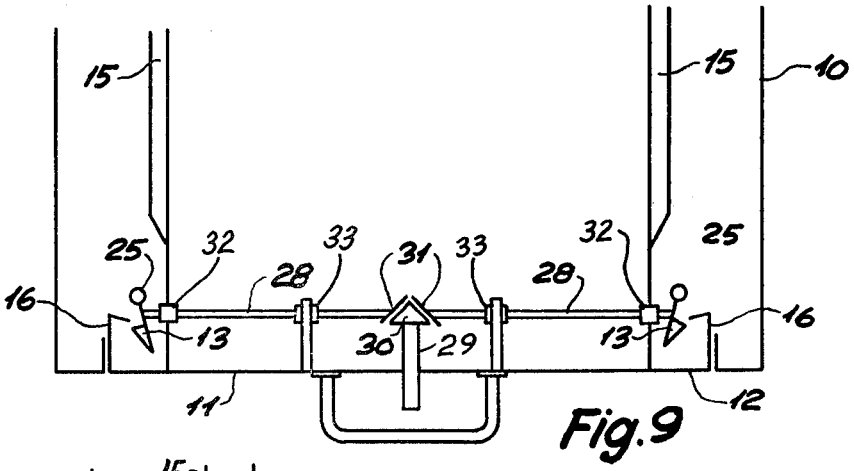
Figure 3A:
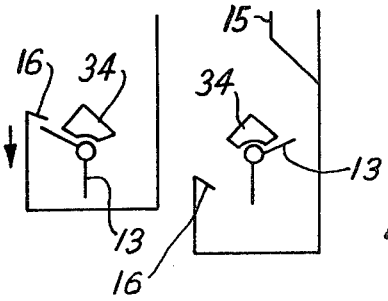

The invention will be further explained below with reference to the drawings, in which FIG. 1 is an isometric representation of an embodiment of the cabinet according to the invention, FIGS. 2 and 3 are enlarged schematic sectional views taken along lines II—II and III—III of FIG. 1, FIG. 3A is a detailed sectional view illustrating the operation of bar 13 of FIGS. 2 and 3 apparatus;

FIGS. 4–8 are cross-sectional views of various embodiments of the locking bar, and FIG. 9 is a horizontal sectional view showing a master locking assembly with two locking devices on respective sides of a cabinet.

In the drawings numeral 10 designates a cabinet having a plurality of drawers 11, one of which is shown as halfway open in FIG. 1. The front plate of each drawer is larger than the cross section of the drawer and projects from either side of the drawer as indicated at 12. Within each of these projecting side portions 12 of the drawers there is pivotally mounted a vertical locking bar 13, which in the embodiment shown in FIGS. 1–3 is of angular cross section, the angle between the legs being slightly more than 90°. The bearings of the locking bars are disposed at the top and bottom on the cabinet, and their pivot axes are designated 14. Either side of each drawer is provided with a rail 15 extending from a point spaced from the front plate to the rear of the drawer. At each upper corner of every front plate there is arranged a rearward and inwardly directed retaining hook 16, which has a certain degree of resiliency.

The pivotal movement of the locking bars is defined by stopping means 34 at one end of bar 13, which limits the pivotal movement, for example to the angles illustrated in FIG. 3A. In FIGS. 2 and 3 they are shown in one extreme position, where the left locking bar is concerned, for clockwise movement, and with respect to the right one, for anticlockwise movement. In this extreme position the outer leg extends below the corresponding retaining hook 16. In the second, not shown extreme position of the left locking bar for anticlockwise movement and of the right one for clockwise movement, the outer leg is disposed within the path of movement of the retaining hook 16, and the inner leg extends in front of the corresponding rail 15 of the drawer.

With all drawers closed, as shown in FIG. 2, the locking bars 13 will be in or proximate their first extreme position, being the one indicated in the figure. As a drawer, e.g. the one shown in FIG. 2, is pulled out, the locking bars 13 will first be pivoted by the retaining hooks during the latters' passage, and after theat they will be reversed by the rails 15 urging the inner legs outwardly. While the drawer is pulled out as indicated in FIG. 3, the locking bars will be ratained in this position in which their outer legs extend below the retaining hooks 16 of the other drawers and therefore prevent other drawers from being pulled out.

When the open drawer is closed again, the locking bars 13 are released by the rails 15 a little before the drawer is completely closed, and during the latter part of the closing movement the bevelled rear of each retaining hook 16 will engage the outer leg of the locking bar and pivot same to abut the not shown stopping means, after which the retaining hook is urged outwardly against its own spring action and will snap back as soon as its hook portion has passed the outer leg of the locking bar. The state shown in FIG. 2 now has been re-established to allow any drawer to be pulled out.

In practice the locking bars 13 may be formed in a variety of ways, some of which are shown in FIGS. 4–8. The locking bar of FIG. 4 consists of a tube 20 which is welded to a bent plate 21 and provided with bearing pins 23 at the ends. A locking bar of this type has relative great flexural strength in all directions.

Figure 5:
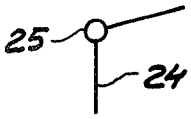

The most simple embodiment is shown in FIG. 5 and consists of an angular bent plate 24 welded to a spindle 25 at its vertex.

Figure 6:
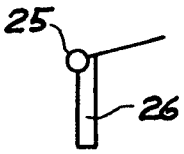

The embodiment shown in FIG. 6 distinguishes from that of FIG. 5 in that one leg 26 is hollow and of substantially rectangular cross section, to thereby impart to the locking bar a high degree of rigidity in the direction of the stress of deflection.

FIG. 7 shows a structure similar to that of FIG. 5 but supplemented with a plate interconnecting the extremities of the two legs so as to form a closed triangular cross section. Also this embodiment has a high degree of rigidity.

The triangular cross-sectional configuration is seen again in the structure shown in FIG. 8, but in this case the spindle 25 is moved away from the vertex and connected to the bar through short upper and lower rods 27.

FIG. 9 shows a cabinet having two locking devices with locking bars 13 of the type indicated in FIG. 8, and which further comprises a master locking assembly arranged at the top of the cabinet. This includes two sliding rods 28 disposed end to end transversely of the cabinet and being guided in bearings 32, 33 so as to be longitudinally slidable and unable to pivot. A master locking pin 29 is arranged in the front of the cabinet at right angles thereto, said pin being axially movable and the inner end of which is provided with a wedge-shaped member 30 disposed between two cam plates 31 being mounted at an oblique angle on the inner end of the respective sliding rods 28. In the shown inoperative position of the master locking assembly and the locking bars 13 the extreme ends of the sliding rods are disposed close to the latter somewhat spaced from the spindles 25. As the master locking pin 29 is pushed in, the wedge-shaped member 30 will move the sliding rods 28 outwardly in opposite directions, and the latter will move the locking bars 13 into the locking position to prevent opening of any drawer. If a drawer is open when the master locking assembly is actuated, it is still possible, however, to close it owing to the resiliency of the retaining hooks. It will be noted that the two locking devices 13, 16 operate quite independently of each other although they may be actuated by a common master locking assembly.

What I claim is:

1. A cabinet comprising:

an enclosure having vertically adjacent openings for receiving drawers;

a plurality of drawers mounted to said enclosure for horizontal movement between open and closed positions at least one vertical locking bar pivotably mounted to said enclosure along a side thereof adjacent said openings; said locking bar having at least one eccentric portion extending outward from the pivot axis and extending in the axial direction substantially the entire locking bar length, said locking bar thereby being of a substantially uniform cross section with respect to which the pivot axis is eccentrically located, and said locking bar being rotatable about said pivot axis between a locking position and a release position;

at least one cam rail mounted to the side of each drawer facing said locking bar, said cam rail being arranged to engage and rotate said locking bar into said locking position on movement of any one of said drawers to its open position;

and, at least one retaining hook mounted to each drawer for engaging said locking bar when said locking bar is in said locking position and said drawer is closed.

2. A cabinet as specified in claim 1 wherein there is additionally provided stopping means mounted to said enclosure for limiting the pivotal movement of said locking bar.

3. A cabinet as specified in claim 1 wherein said locking bar is fabricated from sheet metal bent at an angle.

4. A cabinet as specified in claim 3 wherein said locking bar pivots on an axis which passes through the vertex of said angle.

5. A cabinet as specified in claim 3 wherein said locking bar pivots on an axis which is spaced from the vertex of said angle in the direction away from said openings when said bar is mounted in said enclosure.

6. A cabinet as specified in claim 3 wherein said locking bar includes an additional sheet metal member interconnecting the ends of said sheet metal angle.

7. A cabinet as specified in claim 1 wherein each of said drawers is provided with a front plate projecting laterally from the sides of said drawers and wherein said retaining hook is secured to said front plate at one lateral edge of said plate, said hook being made of resilient material and having a rearward facing cam surface whereby when said drawer is closed with said locking bar in said locking position, said retaining hook deflects and passes said locking bar.

8. A cabinet as specified in claim 7 wherein there is provided means for locking all of the drawers of said cabinet comprising means for manually rotating said locking bar into said locking position and maintaining said locking bar in said locking position.

9. A cabinet as specified in claim 8 wherein there are provided two of said locking bars, one on each side of said openings, and wherein said manual locking devices actuates both of said locking bars independently.

10. A cabinet as specified in claim 1 wherein there are provided two of said locking bars arranged on opposite sides of said openings.

11. A cabinet as specified in claim 1, wherein said retaining hook is resilient and provided with a rearwardly facing, oblique cam face, whereby said hook is capable of riding over and passing said locking bar when its associated drawer is moved into the closed position.

12. A cabinet as specified in claim 1, wherein said locking bar is configured to be rotated into said release position by the hook of one drawer as said one drawer is opened, if it is not held in said locking position by the cam rail of another drawer.

* * * * *